US006960099B2

(12) United States Patent
McAlonis

(10) Patent No.: US 6,960,099 B2
(45) Date of Patent: Nov. 1, 2005

(54) LOW PROFILE INTERFACE CONNECTOR

(75) Inventor: Matthew Richard McAlonis, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/792,047

(22) Filed: Mar. 3, 2004

(65) Prior Publication Data

US 2005/0197007 A1 Sep. 8, 2005

(51) Int. Cl.[7] ..... H01R 13/73
(52) U.S. Cl. ..... 439/545
(58) Field of Search ..... 439/545, 549

(56) References Cited

U.S. PATENT DOCUMENTS

| | | | | |
|---|---|---|---|---|
| 5,127,852 | A * | 7/1992 | Cravens et al. | 439/545 |
| 6,176,738 | B1 * | 1/2001 | Consoli et al. | 439/545 |
| 6,312,285 | B1 * | 11/2001 | Berg et al. | 439/545 |
| 6,428,352 | B1 * | 8/2002 | Boyden | 439/545 |
| 6,843,674 | B1 * | 1/2005 | Young | 439/545 |

* cited by examiner

*Primary Examiner*—Renee Luebke

(57) ABSTRACT

An electrical connector having a shroud and a skirt is provided. The shroud includes opposed side walls configured to retain a plurality of contact pins. The skirt extends from an end of the side walls of the shroud, and the skirt has a surface facing the shroud and a latch member extending from the surface.

19 Claims, 10 Drawing Sheets

LOW PROFILE INTERFACE CONNECTOR

BACKGROUND OF THE INVENTION

This invention relates generally to electrical connectors and, more particularly, to electronic devices using low profile interface connectors.

As handheld electronic devices are becoming more and more popular, the need to interface these handheld electronic devices to enhance their capabilities and functions with external devices such as personal computers and battery chargers also grows. Conventionally, an interface connector is mounted on the electronic device and mated with an external device via a plug assembly which is connected to the external device, thereby achieving electrical connection between the electronic device and the external device.

Advancements in electronic packaging have enabled a dramatic reduction in size of electronic devices. As such, modern handheld electronic devices are particularly slim, sometimes referred to as having a low profile or thickness. Furthermore, electronic devices are increasingly being combined with other products such as wristwatches, cellular phones, pocket calculators and similar devices to provide more functionality to those products. The low profile of such devices, however, cannot be accommodated by existing interface connectors. If increasingly smaller devices are to be interfaced with external devices, a new connection scheme must be provided.

BRIEF DESCRIPTION OF THE INVENTION

According to an exemplary embodiment of the present invention, an electrical connector is provided. The electrical connector comprises a shroud and a skirt. The shroud has opposed side walls and is configured to retain a plurality of contact pins. The skirt extends from an end of the side walls of the shroud. The skirt has a surface facing the shroud and a latch member extending from the surface.

In another exemplary embodiment of the present invention, an electrical connector for a low profile electronic device having an outer cover is provided. The electrical connector comprises a shroud and a skirt. The shroud includes opposed side walls configured to retain a plurality of contact pins. Each of the side walls include a keying flange for installing the shroud to the cover. The skirt extends from an end of the side walls of the shroud in a direction substantially parallel to the keying flanges extending from the shroud. The skirt resiliently retains the cover to the keying flanges when the connector is installed.

In yet another exemplary embodiment of the present invention, an electrical device is provided. The electrical device comprises a circuit board, an outer cover, an interface connector, and a plurality of spring loaded pins. The outer cover extends over the circuit board and includes an opening therein having a keyed contour. The interface connector has a shroud configured to be inserted through the opening in the outer cover. The shroud is configured to receive a mating plug and has a plurality of keying flanges corresponding to the keyed contour when the shroud is inserted through the cover. The interface connector also has a skirt extending outward from the cover and resting upon an outer surface of the cover when the shroud is inserted through the cover. The skirt and the flanges resiliently retain the cover therebetween. The plurality of spring loaded pins are received in the shroud and are in electrical contact with the circuit board.

DETAILED DESCRIPTION OF THE INVENTION

Figure 1:
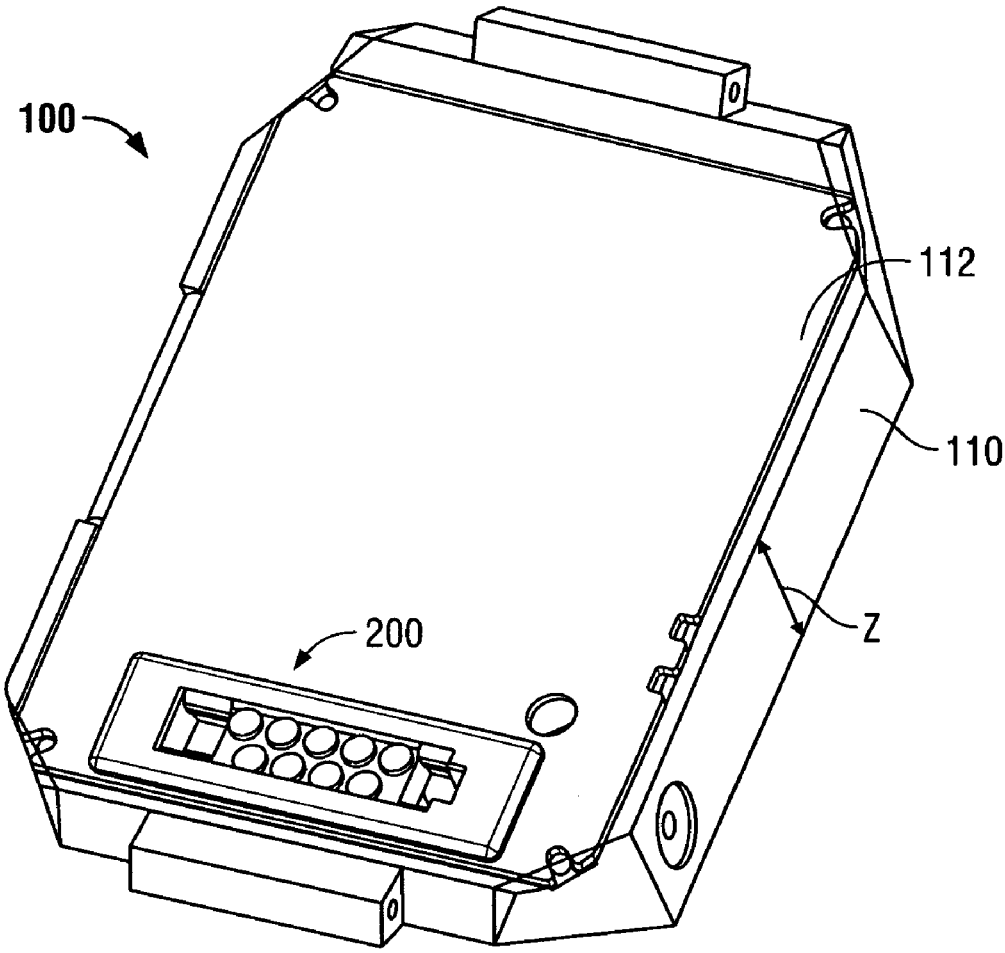
FIG. 1 is bottom perspective view of an exemplary electrical device according to the present invention.

FIG. 1 illustrates a low profile electronic device 100 formed in accordance with an exemplary embodiment of the invention. In the illustrative embodiment, the device 100 is a personal digital assistant, sometimes referred to as a "PDA", and more specifically, a wristwatch PDA. It is appreciated, however, that the benefits and advantages of the invention may occur in a variety of devices, and while the invention is described and illustrated in the context of a wristwatch PDA, the invention is not intended to be limited thereto. It is recognized that the invention can be utilized in a variety of devices for a variety of applications.

In an exemplary embodiment, the device 100 includes an outer casing 110 having a generally rectangular shape and a low profile dimension Z which is, for example, less than 1 cm. The casing 110 includes a back cover 112 that has an opening or slot (not shown in FIG. 1) for receiving a low profile electrical connector 200 described in detail below. The device 100 further includes a circuit board (not shown in FIG. 1) which may communicate with an external device via the connector 200.

Figure 2:
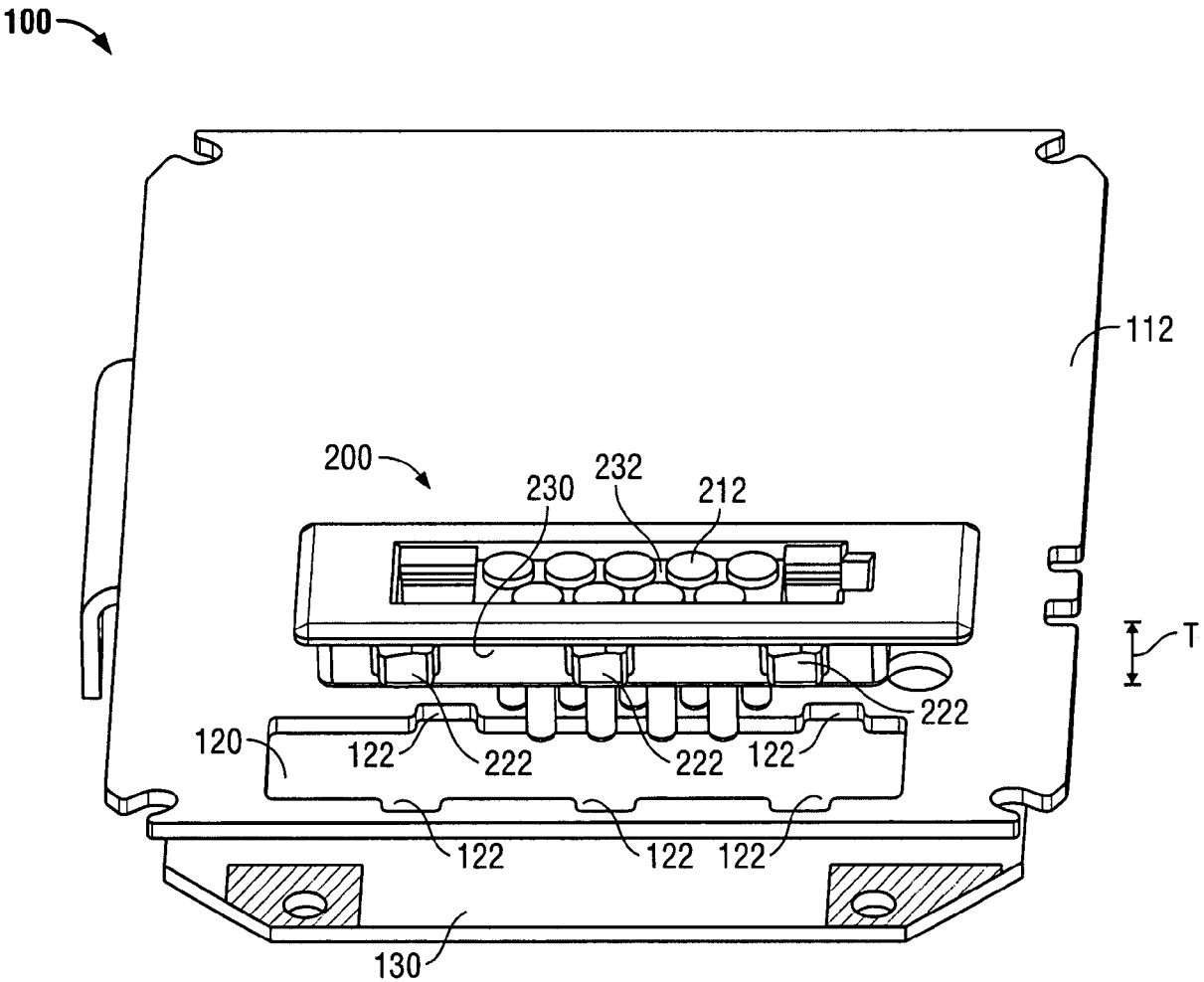
FIG. 2 is an exploded view of the electrical device shown in FIG. 1, showing an electrical connector.

FIG. 2 illustrates an exploded perspective view of the device 100 including the back cover 112, a circuit board 130, and the connector 200. The back cover 112 includes an opening or slot 120 which is sized for receiving and retaining the connector 200, as will be described in detail below. The opening 120 generally has a rectangular shape and, in an exemplary embodiment, further includes a keyed contour including at least one keying feature or notch 122. The opening 120 can have any number of keying features 122, and in an exemplary embodiment, the opening 120 has a plurality of keying features 122 where one side has a greater number of keying features 122 than the other side. In the illustrative embodiment, the opening 120 has three notches 122 on one side and two notches 122 on the opposite side.

In an exemplary embodiment, the connector 200 is generally rectangularly shaped and is sized to fit into the opening 120 such that the connector 200 is dimensioned in thickness T to a thickness less than the dimension Z (shown in FIG. 1) of the device 100. The connector 200 is coupled to the back cover 112 in the manner described below. In an exemplary embodiment, the connector 200 includes contact pins 212 which engage the circuit board 130 for communication with an external device (not shown) via a patch cord or a plug (not shown). In an illustrative embodiment, the pins 212 are spring loaded Pogo® type electrical contacts, such as those available from Pylon Corporation, located in Attleboro, Mass.

The circuit board 130 includes circuitry and components for executing control algorithms and user input commands according to known techniques, and program parameters and data may be transmitted and received via the connector 200. The circuit board 130 is positioned within the casing 110 (shown in FIG. 1) and is positioned such that when the connector 200 is inserted into the opening 120, the pins 212 engage the circuit board 130 and establish electrical communication therewith. In an exemplary embodiment, the connector 200 is a low profile interface connector 200 having spring loaded Pogo® type pins 212, such as those available from Pylon Corporation, located in Attleboro, Mass., that interface with the printed circuit board 130 and provide for communication with an external electronic device (not shown), such as, for example, a personal computer or a battery charger, through an appropriate plug or patch card (not shown).

The connector 200 further includes keying features 222 which correspond to the keying features 122 in opening 120. The keying features 222 may be, for example, ribs or flanges as shown in FIG. 2. The connector 200 can have any number of keying features 222, and in an exemplary embodiment, the connector 200 has a plurality of keying features 222 where one side 230 has a greater number of keying features 222 than the opposed side 232. An unequal number of keying features 222 on the opposed sides 230, 232 ensures proper orientation of the connector 200 for installation. Any attempt to install the connector 200 in another orientation will be frustrated.

Figure 3:
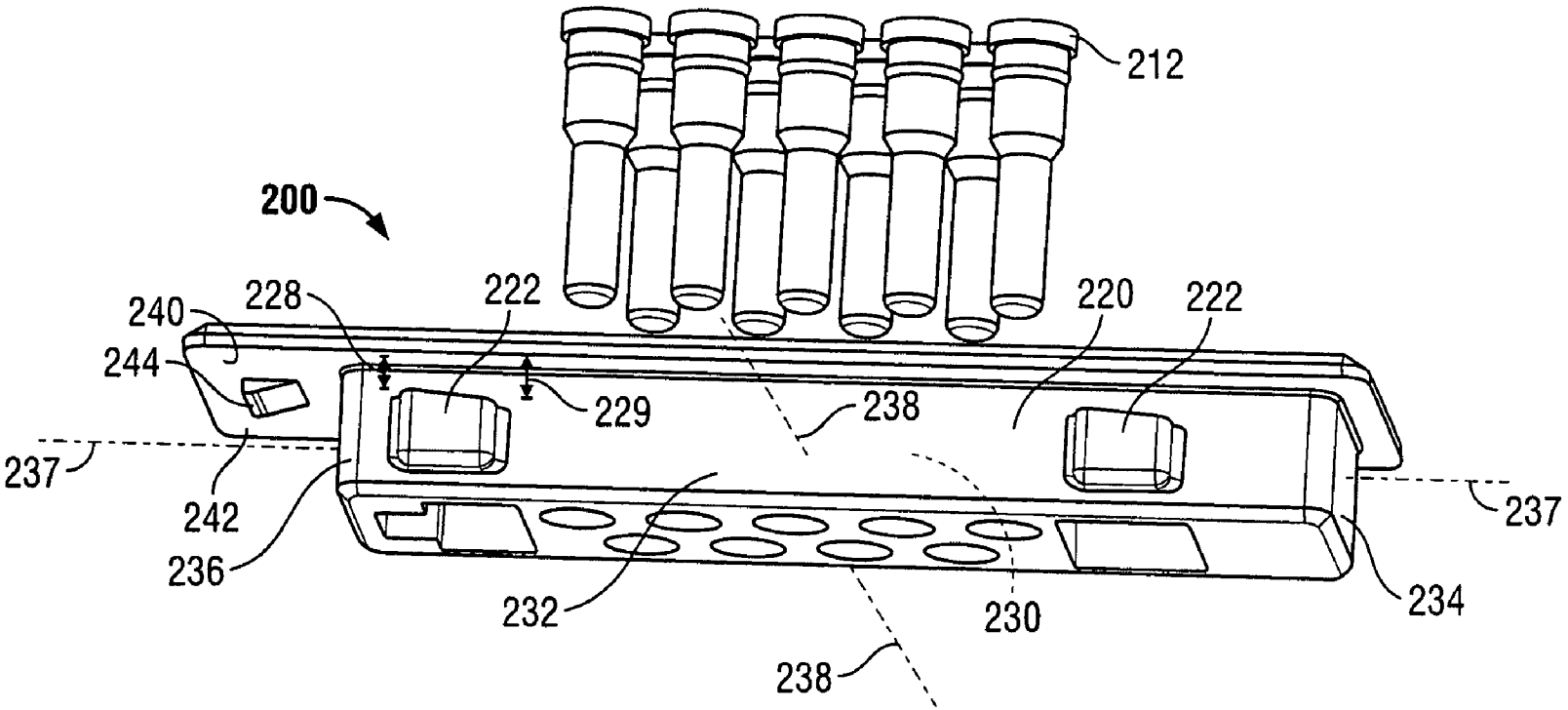
FIG. 3 is an exploded view of the electrical connector shown in FIG. 2.
Figure 4:
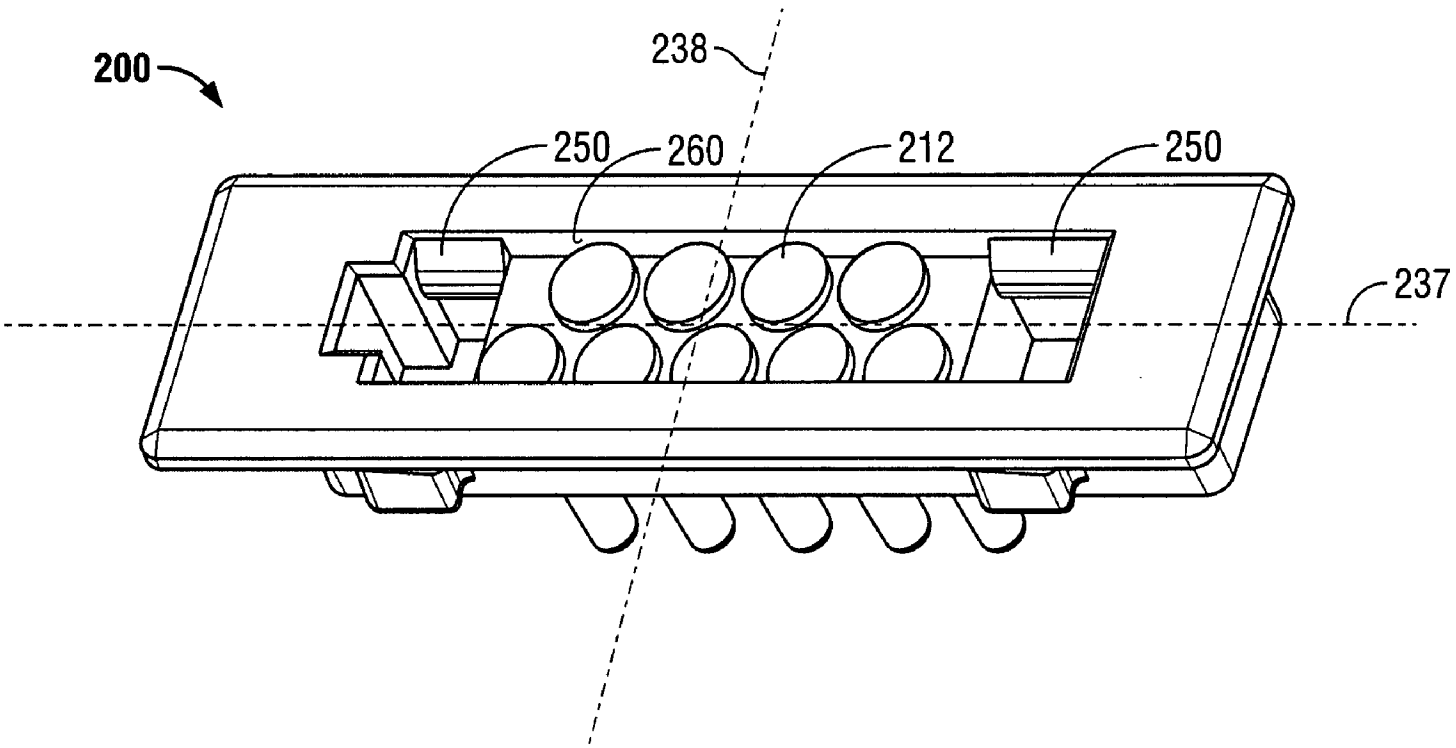
FIG. 4 is a top perspective view of the electrical connector shown in FIGS. 2 and 3.

FIG. 3 illustrates an exploded view of the connector 200 in an exemplary embodiment of the present invention. The connector 200 includes a skirt 240 and a shroud 220. The shroud 220 is generally rectangular in shape and includes opposing side walls 230, 232 and opposing end walls 234, 236. The shroud 220 includes a longitudinal axis 237 and a lateral axis 238, as shown in FIG. 4, wherein the side walls 230, 232 are substantially parallel to the longitudinal axis 237 and the end walls 234, 236 are substantially parallel to the lateral axis 238. The shroud 220 retains the pins 212 and in an exemplary embodiment, the connector 200 has two rows of pins 212, where one row has a greater number of pins 212 than the other row and the rows of pins 212 are offset from one another such that the rows can be spaced closer together. The side walls 230, 232 are further configured to include at least one keying feature 222. In the illustrative embodiment, the keying features 222 are keying flanges or ribs which extend outward from each of the side wall 230 (shown in FIG. 2) and 232 (shown in FIG. 3).

The skirt 240 is generally rectangular in shape, extends outward from the shroud 220, and includes a surface 242 from which the shroud 220 extends. The surface 242 extends outward from the end walls 234, 236 in a direction which is substantially parallel to the longitudinal axis 237 of the shroud 220, and also extends outward from the side walls 230, 232 in a direction which is substantially parallel to the lateral axis 238. As such, where the surface 242 extends from the side walls, the surface 242 extends in a direction that is substantially parallel to the direction which the keying features 222 extend from the shroud 220, forming a space 228 between the surface 242 and the top of the keying features 222. The space 228 is approximately equal to the thickness of the back cover 112 (shown in FIG. 2), and when the connector 200 is placed in the locked position, the back cover fills the space 228 between the surface 242 and the top of the keying flange 222. The skirt 240 and the keying features 222 are positioned to resiliently retain the back cover 112 when the connector 200 is installed, as will be described below. In an exemplary embodiment, the skirt 240 includes a latch member 244, or locking member, which is aligned on the skirt 240 with the shroud 220 longitudinal axis and which extends from the surface 242 in the same direction as the shroud 220.

FIG. 4 illustrates a top perspective view of the connector 200. The connector 200 includes a receptacle 260 for a patch cord or a plug (not shown in FIG. 4). The pins 212 are accessible through the receptacle 260 for connection to the electrical contacts in the plug (not shown in FIG. 4). The connector 200 further includes locking features 250 for mating the plug to the device 100. In the illustrative embodiment, the locking features 250 are clips which engage resilient latching features (not shown in FIG. 4), as explained below, located on plug.

Figure 5:
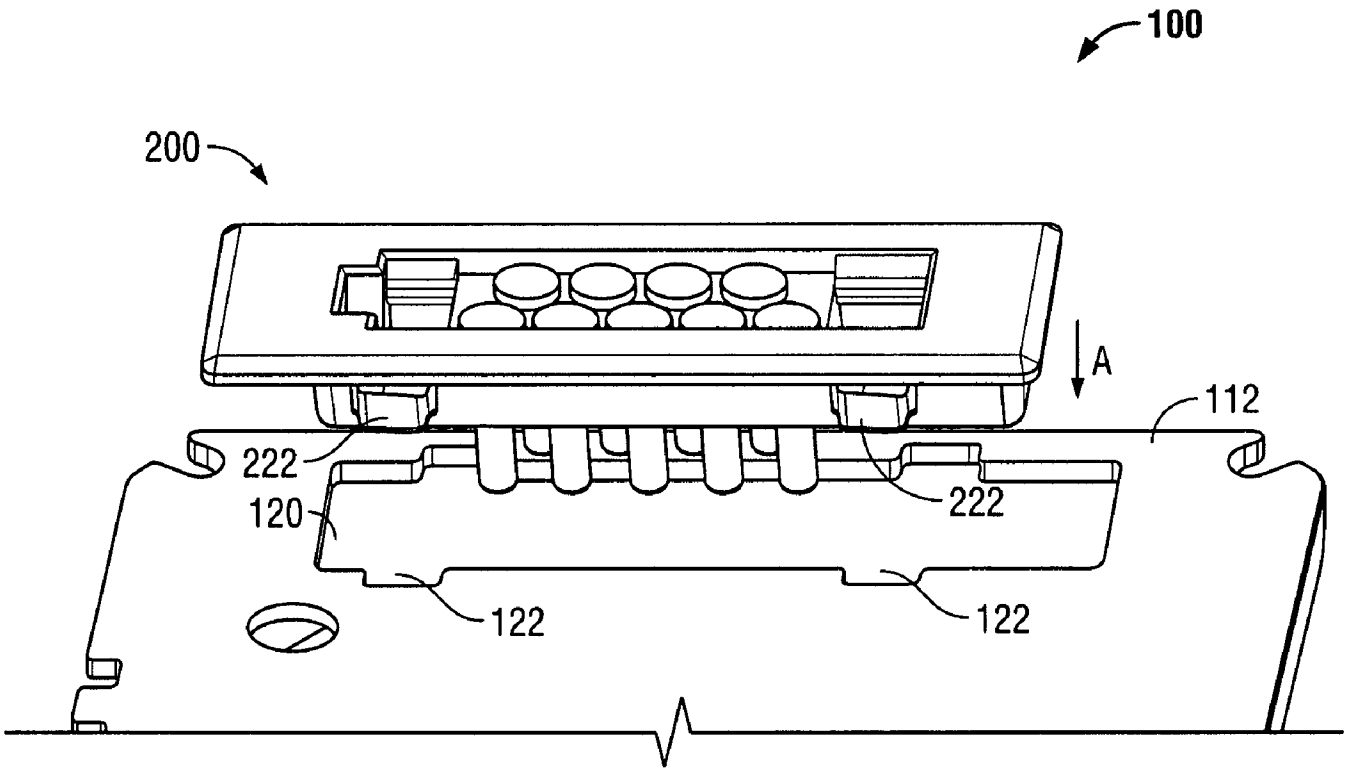
FIG. 5 is an exploded view of the electrical device shown in FIG. 1, showing the direction of insertion of the electrical connector into the electrical device.

FIG. 5 illustrates the connector 200 in a position relative to the back cover 112 just prior to insertion into the device 100. The connector 200 is inserted into the opening 120 in the back cover 112 in the direction of arrow A when the keying flanges 222 are aligned with the notches 122 in the opening 120.

Figure 6:
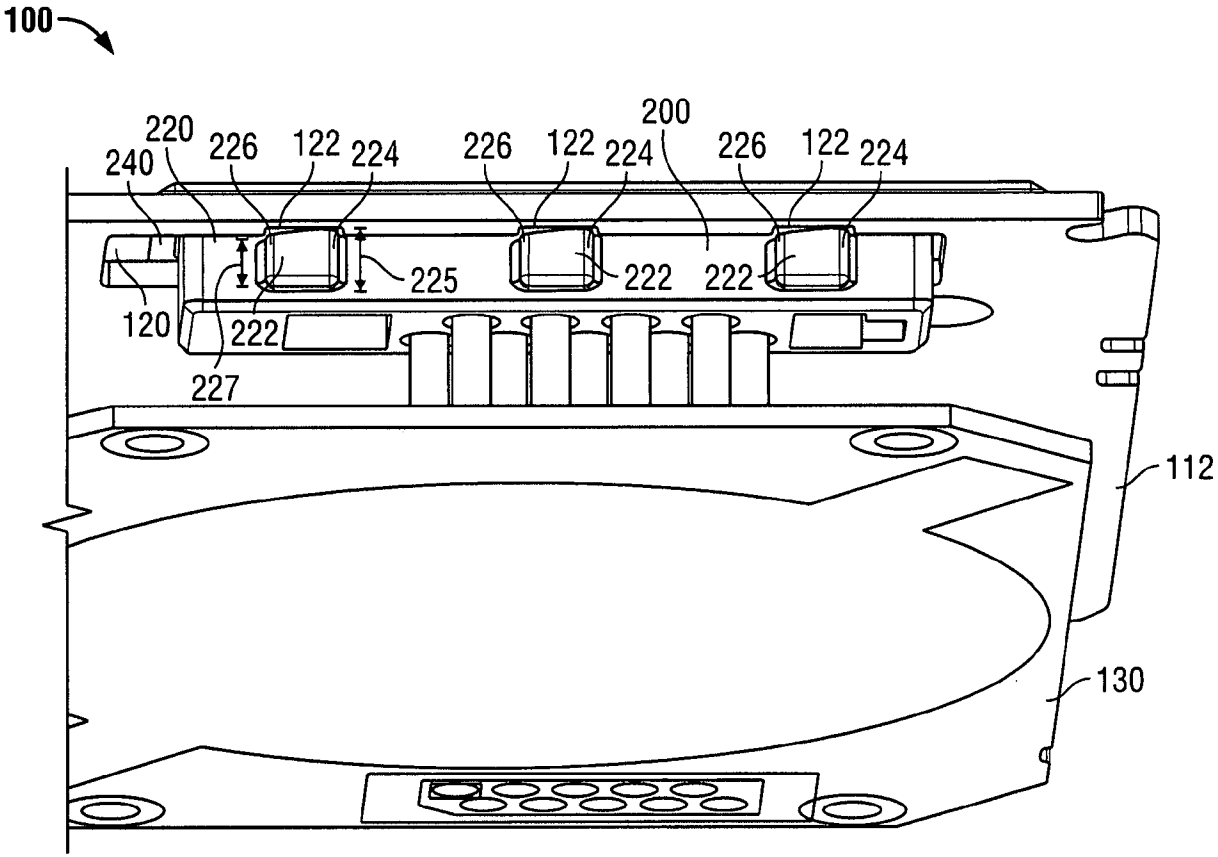
FIG. 6 is a bottom perspective view of the electrical device shown in FIG. 1, showing the electrical connector in the unlocked position.

FIG. 6 illustrates the connector 200 in an unlocked position after insertion into the device 100. In an exemplary embodiment, the opening 120 is sized to allow the shroud 220 to be inserted into the device 100, while the skirt 240 engages the back cover 112, and in this position, the keying flanges 222 and the notches 122 are aligned. The keying flanges 222 include an upstream side 224 and a downstream side 226, and the flanges are tapered between the upstream and downstream sides such that the upstream side 224 has a length 225 which is greater than a length 227 of the downstream side 226. Consequently, a space 228 (shown in FIG. 3) between the upstream side 224 and the surface 242 is less than a distance 229 (shown in FIG. 3) between the downstream side 226 and the surface 242 (shown in FIG. 3). The space 228 is substantially equal to the thickness of the back cover 112, while the distance 229 between the downstream side 226 and the skirt 240 is greater than the thickness of the back cover 112. As such, when the connector 200 is moved into the locked position, as described below, the downstream side 226 of the keying flanges engages the back cover 112 and the connector 200 tightens against the back cover 112 as the upstream side 224 of the keying flanges slide to engage the back cover 112. Additionally, while the connector 200 is in the unlocked position, the locking member 244 (shown in FIG. 3), which extends from the skirt 240 is resting on the back cover 112. When the connector 200 is moved to the locked position, as described below, the locking member 244 is positioned in the opening 120.

Figure 7:
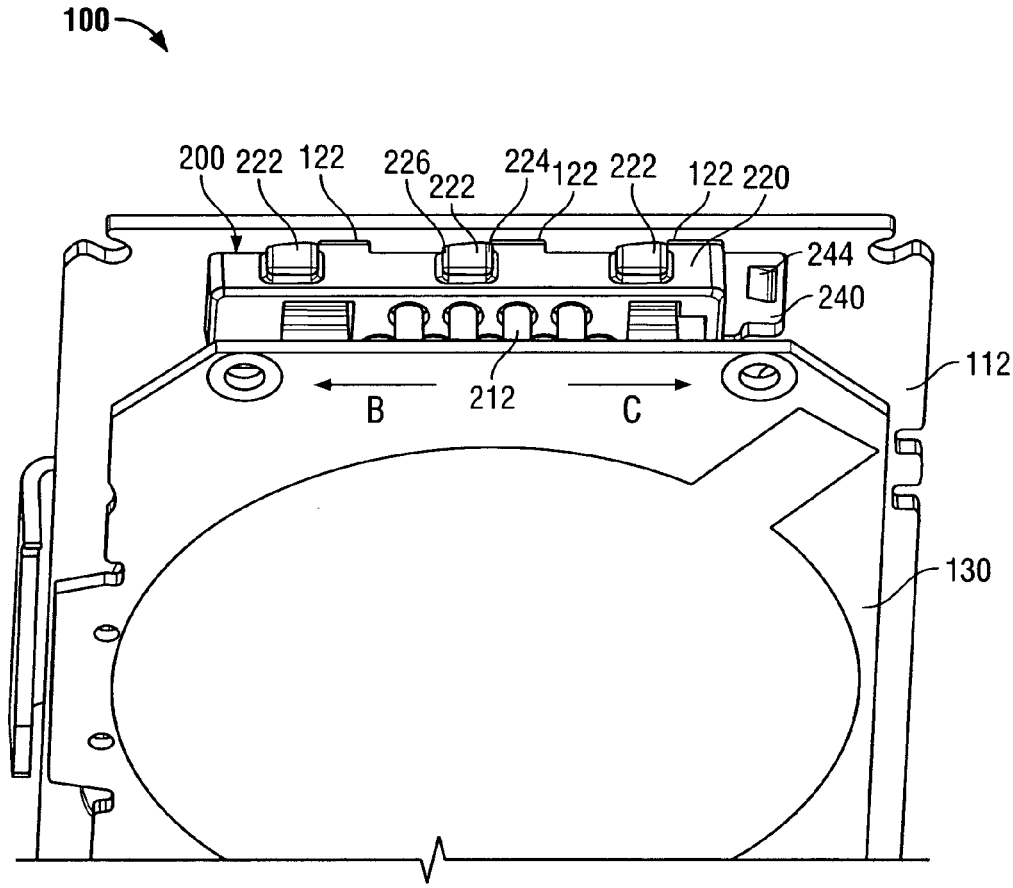
FIG. 7 is a bottom perspective view similar to the view in FIG. 6, showing the electrical connector in the locked position.

FIG. 7 illustrates the connector 200 in a locked position relative to the device 100. The connector 200 is locked with respect to the device 100 without the use of any tools or hardware, and is in electrical contact with the circuit board 130 without any soldering of the pins 212. The connector 200 is placed in the locked position by moving or sliding the connector 200 in the direction of arrow B from the unlocked position (shown in FIG. 6). In the locked position, the keying flanges 222 are offset from the notches 122 in the opening 120, which prevents the connector 200 from being removed from the device 100 in a direction opposite of arrow A (also shown in FIG. 5). The keying flanges 222 engage the back cover 112 as the connector 200 is moved in the direction of arrow B. As discussed above, the length 225 of the upstream side 224 of the keying flanges 222 is greater than the length 227 of the downstream side 226 of the keying flanges 222 such that the upstream side 224 is longer than the downstream side 226. As the connector is being slid into the locked position, the downstream side 226 is the first side to engage the back cover 112 when the connector 200 is moved in the direction of arrow B, and due to the distance 229 between the downstream side 226 and the skirt 240 being greater than the thickness of the back cover 112, the downstream side 226 easily slides beyond the notch 122 and engages the back cover 112. As the connector 200 is further slid into the locked position in the direction of arrow B, the skirt 240 is tightened with respect to the back cover 112 until the connector 200 is in the locked position, at which time the connector 200 is frictionally engaged with the device 100 due to the space 228 between the upstream side 224 and the skirt 240 being substantially equal to the thickness of the back cover 112.

In the locked position, the locking member 244 is positioned within the opening 120. The locking member 244 extends from the skirt 240 in the same direction as the shroud 220, and in an exemplary embodiment the locking member 244 extends a distance which is substantially equal to the thickness of the back cover 112. The locking member 244 prevents removal of the connector 200 in the direction of arrow C. When the connector 200 is in the locked position, the opening 120 is entirely covered by the skirt 240 when viewed from the outside of the device 100, as best seen in FIG. 8.

Figure 8:
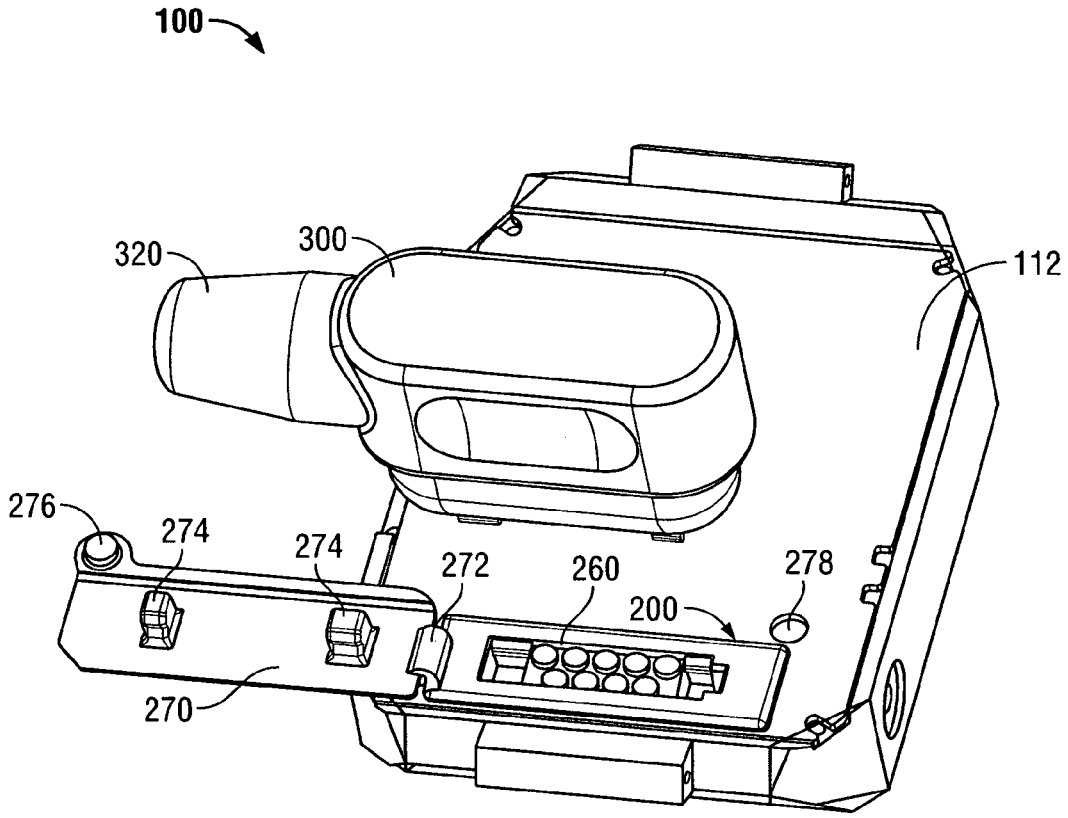
FIG. 8 is a perspective view of the electrical device positioned for mating engagement with a plug.

FIG. 8 illustrates the device 100 positioned to receive a plug 300. As illustrated in FIG. 8, the connector 200 includes a receptacle 260 for the plug 300 and an optional cover 270 that includes latches 274 and a retention feature 276. The cover 270 is attached to the connector 200 with a hinge 272. In an alternative embodiment, the cover 270 does not include the latches 274 and is rigid and is fabricated from plastic. In an exemplary embodiment, the retention feature 276 is sized and positioned to be inserted into a cover retaining opening 278 located on the back cover 112, and is fabricated from rubber so that the retention feature 276 will frictionally engage the cover retention opening 278. The plug 300, as described below, can be interfaced with the device 100 for a variety of functions including, for example, external communication or charging a battery (not shown) located within the device 100.

Figure 9:
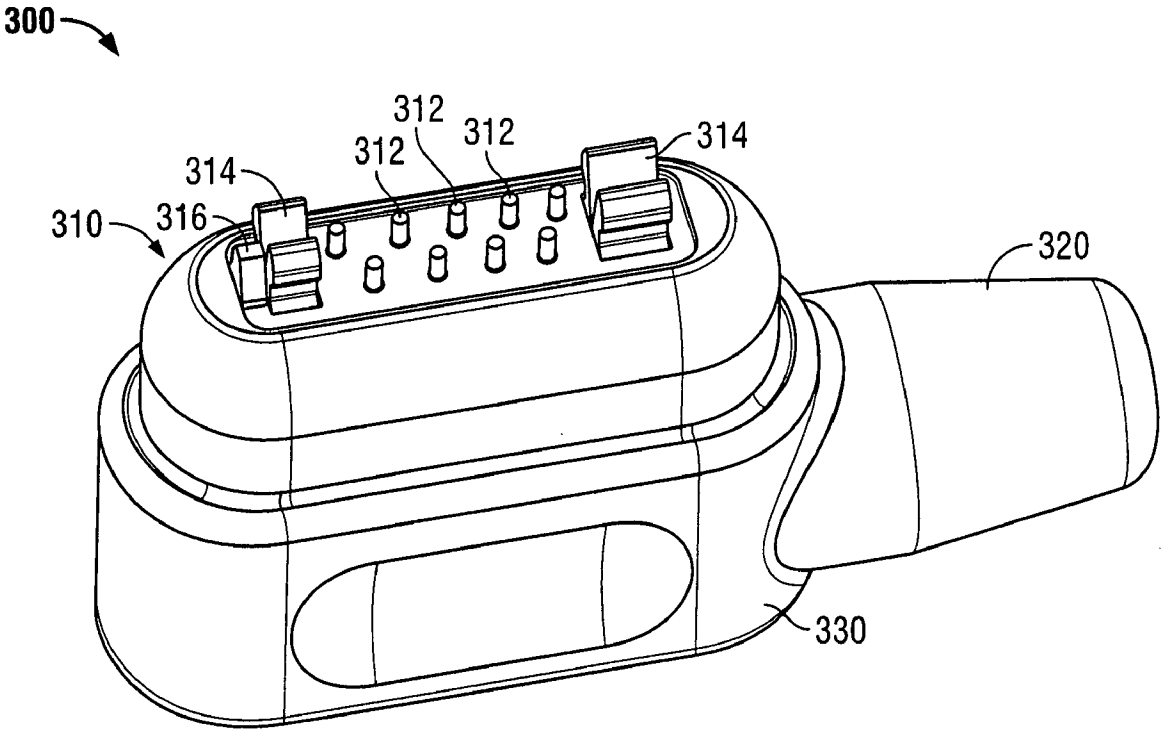
FIG. 9 is a perspective view of the plug shown in FIG. 8.
Figure 10:
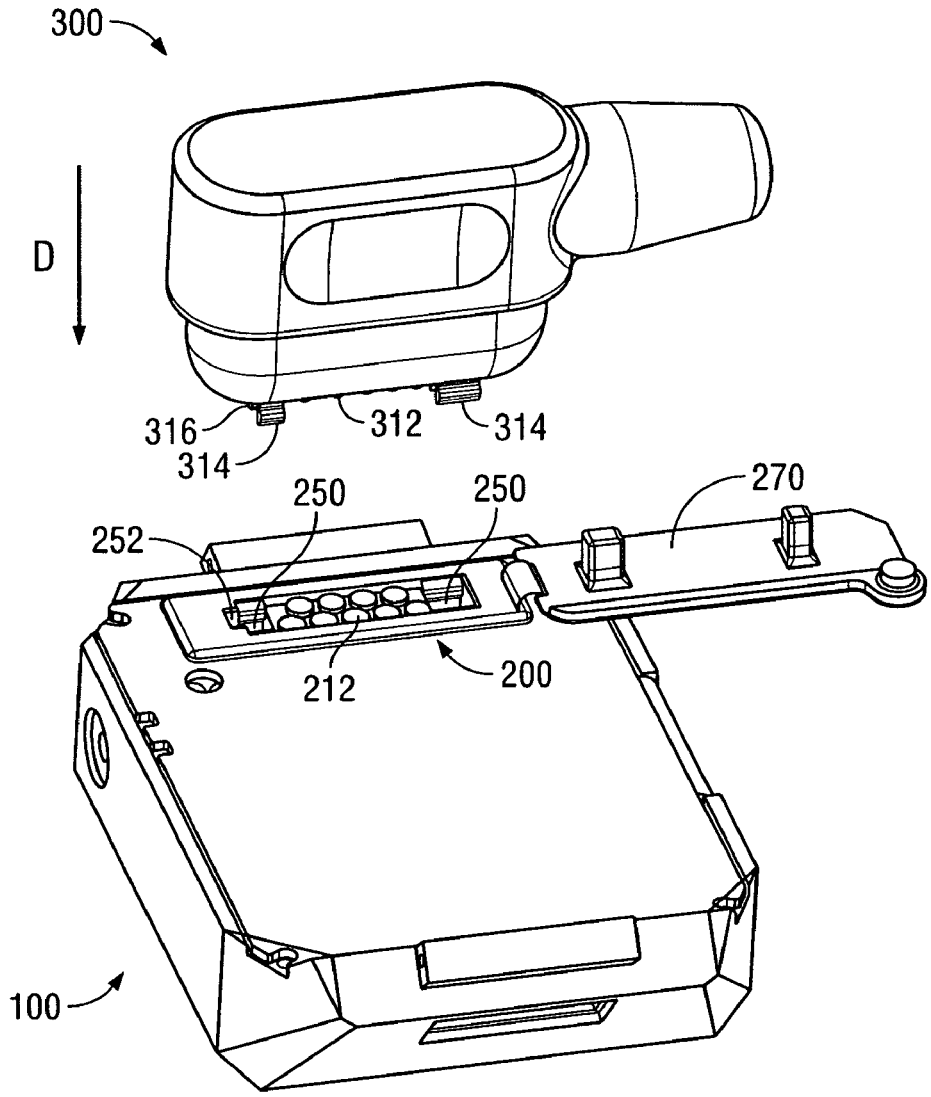
FIG. 10 is a view similar to the view in FIG. 8 showing the mating of the plug with the electrical connector.

FIG. 9 illustrates the plug 300 used to interface with the device 100 in an exemplary embodiment. The plug 300 includes a connector shell 330, a cable 320 and an interface assembly 310. The interface assembly 310 includes resilient latching features 314 which engage the locking features 250 (as shown in FIG. 4) and a plurality of plug contacts 312 which correspond to the connector pins 212 (shown in FIGS. 3, 4, and 7). In an exemplary embodiment, one of the resilient latching features 314 also includes a spacer 316 which corresponds to a similarly shaped notch 252 in the connector 200 (as shown in FIG. 10). In an exemplary embodiment, the cable 320 is attached to the plug 300 at one end and the external device (not shown), such as for example, a computer, at the other end, allowing the device 100 to communicate with the external device. In an alternative embodiment, the cable 320 is attached to the plug 300 at one end and a battery charger (not shown) at the other end, allowing the battery charger to recharge a battery (not shown) located within the device 100.

FIG. 10 illustrates the plug 300 interfacing with the device 100. In use, the device 100 is prepared for interfacing by removing the cover 270, if present, and inserting the plug 300 in the direction of arrow D. The plug 300 must be oriented so that the plug contacts 312 will engage the corresponding pins 212, and so that the resilient latching features 314 will engage the corresponding locking features 250. In an exemplary embodiment, one of the resilient latching features 314 will include the spacer 316 which corresponds to the space 252 in connector 200, thereby allowing the plug 300 to only be inserted in the proper fashion. Additionally, and as shown in FIGS. 4, 9 and 10, the resilient latching features 314 of the plug 300 are of different widths, and the respective locking features 250 of the connector 200 are sized to accept the latching features 314 only when the plug 300 is properly oriented with respect to the connector 200. The spacer 316 and the latching features 314 therefore provide redundant safety features which ensure that the plug 300 may be connected only in a predetermined position and avoids incorrect connection of the plug.

The electronic device as described above provides a low profile connector which can effectively, in a limited dimension Z (shown in FIG. 1), electrically connect an external device to a compact low profile device 100. The low profile electrical connector installed simply and reliably without the use of tools or hardware, and may be manufactured at a relatively low cost.

While the invention has been described in terms of various specific embodiments, those skilled in the art will recognize that the invention can be practiced with modification within the spirit and scope of the claims.

What is claimed is:

1. A low profile electrical connector comprising:

a shroud comprising opposed side walls configured to retain a plurality of contact pins, said side walls having opposed end edges;

a skirt joined to and extending from one of said opposed end edges, said skirt comprising a latch member extending away from said one end edge; and keying flanges extending from said side walls at a location spaced from said skirt.

2. An electrical connector in accordance with claim 1 wherein at least one of said keying flanges includes an upstream side, a downstream side, and a tapered top surface extending between the upstream side and the downstream side, said tapered surface being inclined relative to said skirt to define a decreasing space between said skirt and said tapered surface along a length of said keying flanges, said length extending parallel to a longitudinal axis of said shroud.

3. An electrical connector in accordance with claim 1 wherein each of said opposed side walls comprise a plurality of keying flanges, one of said opposed side walls having a greater number of keying flanges than the other.

4. An electrical connector in accordance with claim 1 wherein said shroud comprises a longitudinal axis and a lateral axis, said skirt extending outward from said shroud in a direction of each of said longitudinal axis and said lateral axis.

5. An electrical connector in accordance with claim 1 wherein said shroud extends along a longitudinal axis, said latch member aligned on said skirt with said longitudinal axis.

6. An electrical connector in accordance with claim 1 wherein said skirt resiliently engages a cover of an electronic device when said connector is installed, said latch member locking the skirt to the cover and preventing removal of the skirt from the cover.

7. An electrical connector in accordance with claim 1 wherein said shroud is configured to receive a plurality of spring loaded pin contacts.

8. An electrical connector for a low profile electronic device having an outer surface, said connector comprising:

a shroud configured to retain a plurality of contact pins between opposed said side walls each having a top edge and a bottom edge, each of said side walls comprising a keying flange spaced from the top and bottom edges for installing said shroud to the outer surface; and a skirt extending from said top edge of said opposed side walls, said skirt slidably engaging and locking the outer surface of the electronic device between the keying flanges and the skirt when said connector is installed, wherein the keying flanges are concealed within the electronic device and the skirt may not be removed.

9. An electrical connector in accordance with claim 8 wherein said skirt further comprises a latch member extending downwardly and away from said surface, said latch member being concealed when said connector is installed and preventing removal of the skirt from the device.

10. An electrical connector in accordance with claim 8 wherein said skirt comprises a latch member and said shroud extends along a longitudinal axis, said latch member being aligned on said skirt with said longitudinal axis.

11. An electrical connector in accordance with claim 8 wherein each of said opposed side walls comprise a plurality of keying flanges, one of said opposed sides having a greater number of keying flanges than the other.

12. An electrical connector in accordance with claim 8 wherein said shroud comprises a longitudinal axis and a lateral axis, said skirt extending outward from said shroud in a direction of parallel to each of said longitudinal axis and said lateral axis.

13. An electrical connector in accordance with claim 8 wherein said shroud is configured to receive a plurality of spring loaded pin contacts.

14. An electrical connector in accordance with claim 8 wherein said shroud is configured to receive a mating plug.

15. An electrical device comprising:

a circuit board;

an outer cover extending over said circuit board, said cover comprising an opening therein, said opening having a keyed contour;

an interface connector comprising a shroud configured to be inserted through the opening in said outer cover, said shroud configured to receive a mating plug and having a plurality of keying flanges corresponding to said keyed contour when said shroud is inserted through said cover, and a skirt joined to a top edge of said shroud, said skirt extending outward from said cover and resting upon an outer surface of said cover when said shroud is inserted through said cover, said skirt and said flanges resiliently retaining and locking said cover therebetween to prevent removal of the connector from said cover, wherein said keying flanges are concealed beneath the cover; and a plurality of spring loaded pins received in said shroud and in electrical contact with said circuit board.

16. An electrical device in accordance with claim 15 wherein said skirt further comprises a a latch member extending beneath and concealed by said skirt when engaged to said cover, said latch member preventing sliding movement of said connector relative to said housing to release said keying flanges from said keyed contour.

17. An electrical device in accordance with claim 15 wherein said shroud extends along a longitudinal axis, skirt further comprising a latch member aligned on said skirt with said longitudinal axis.

18. An electrical device in accordance with claim 15 wherein said shroud comprises opposed side walls, each of said side walls comprising a plurality of keying flanges, one of said opposed sides having a greater number of keying flanges than the other.

19. An electrical device in accordance with claim 15 wherein said shroud comprises a longitudinal axis and a lateral axis, said skirt extending outward from said shroud in a direction of each of said longitudinal axis and said lateral axis.

* * * * *